US005649645A

United States Patent [19]

Demarest et al.

[11] Patent Number: 5,649,645

[45] Date of Patent: Jul. 22, 1997

[54] OVERCAP SPRAYER ASSEMBLY

[75] Inventors: Scott W. Demarest; John J. Gatzemeyer, both of Racine; James E. Buhler, Waterford; Allen D. Miller, Racine, all of Wis.

[73] Assignee: S. C. Johnson & Son, Inc., Racine, Wis.

[21] Appl. No.: 388,778

[22] Filed: Feb. 15, 1995

[51] Int. Cl.[6] ..... B67D 5/33

[52] U.S. Cl. ..... 222/153.07; 222/153.13; 222/153.14; 222/182; 222/402.11; 222/402.12; 222/402.13

[58] Field of Search ..... 222/153.06, 153.07, 222/153.11, 153.13, 153.14, 182, 402.11, 402.12, 402.13, 402.15, 402.21, 402.23

[56] References Cited

U.S. PATENT DOCUMENTS

| | | | |
|---|---|---|---|
| 2,887,273 | 5/1959 | Anderson et al. | 239/337 |
| 3,185,350 | 5/1965 | Ablanalp et al. | 222/182 |
| 3,373,908 | 3/1968 | Crowell | 222/402.13 |
| 3,608,785 | 9/1971 | Durso et al. | 222/402.13 X |
| 3,661,300 | 5/1972 | Nigro | 222/80 |
| 3,729,119 | 4/1973 | Sette et al. | 222/153.11 |
| 3,734,354 | 5/1973 | Gach | 222/402.11 X |
| 3,738,536 | 6/1973 | Gach | 222/182 X |
| 3,744,682 | 7/1973 | Blank | 222/402.13 X |
| 3,747,807 | 7/1973 | Gach | 222/182 X |
| 3,754,689 | 8/1973 | Blank | 222/402.11 |
| 3,844,448 | 10/1974 | Sette | 222/153 |
| 4,513,890 | 4/1985 | Goncalves | 222/153 |
| 5,027,982 | 7/1991 | Demarest | 222/182 |

*Primary Examiner*—Joseph Kaufman

[57] ABSTRACT

An overcap sprayer assembly and method of its manufacture. The overcap sprayer assembly includes an actuator and an overcap. The actuator has a body and a sprayer arm. The body attaches preferably to the valve cup rim of the can. A skirt extends circumferentially around the perimeter of the body. At least one actuator access port provides access through the skirt to the interior of the body. The sprayer arm of the actuator has a nozzle adapted to direct spray outwardly through an actuator access port. The overcap attaches to the skirt of the actuator body in coaxially turning relation thereto. An overcap wall extends downwardly from the outer margins of the overcap dome, surrounding the actuator body. The overcap also has at least one overcap access port that may be moved between an open position, wherein an overcap access port is aligned with the actuator access port through which the nozzle is adapted to direct spray, and a closed position, wherein the overcap wall obstructs the actuator access port. Preferably a lock member extends from one of the actuator body and the overcap to project into and engage an opposed locking port of the other of the actuator body and overcap. Preferably the locking port is an access port. The lock member has an unlocked position, wherein it is not engaged in an opposed locking port and the overcap may freely turn on the actuator body, and a locked position assumed when the lock member becomes aligned with an opposed locking port, projects thereinto, and engages the opposed locking port, resisting further overcap turning.

26 Claims, 7 Drawing Sheets

FIG. 10
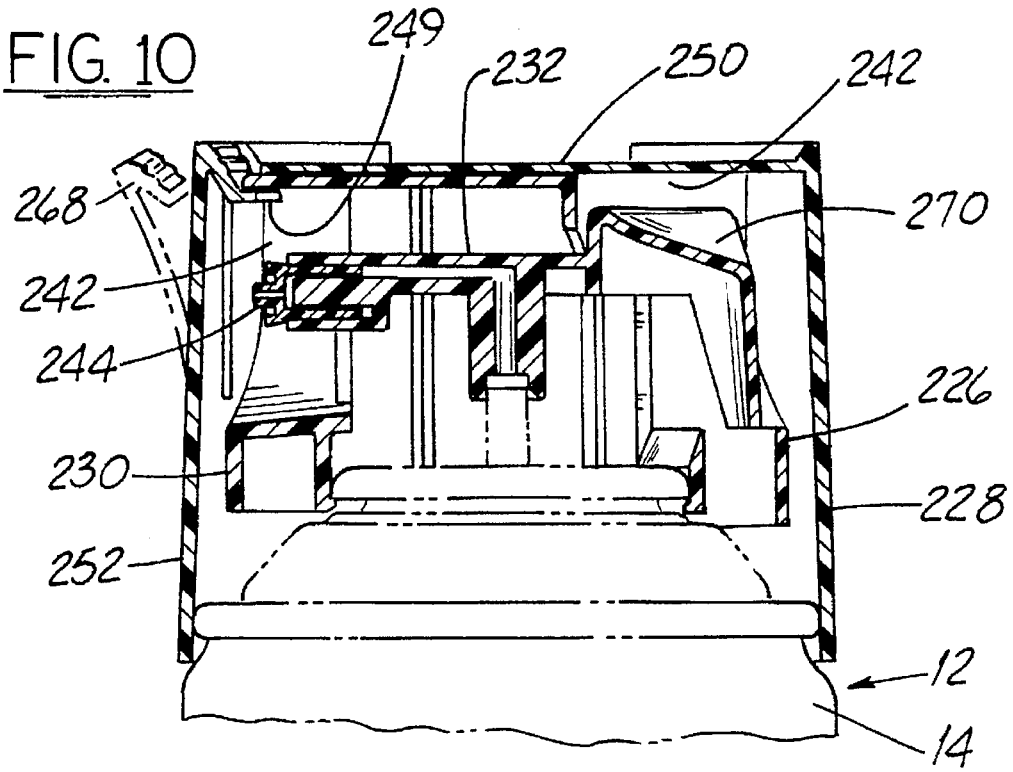
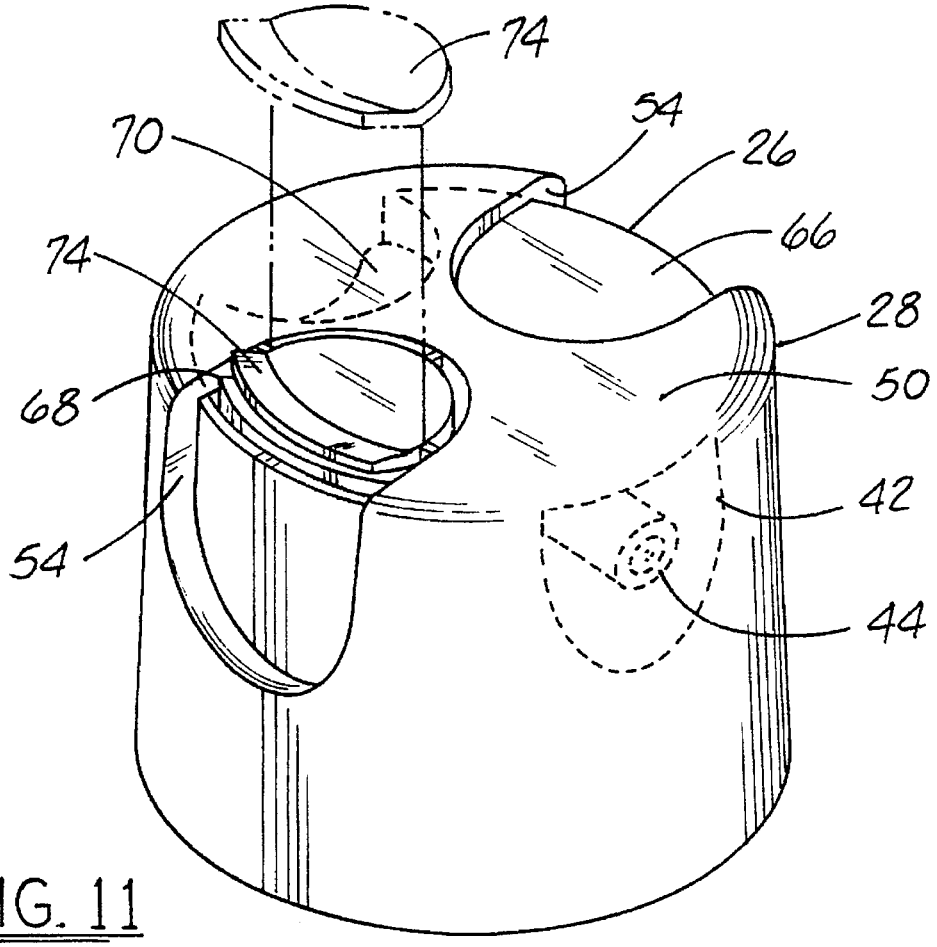
FIG. 11

OVERCAP SPRAYER ASSEMBLY

TECHNICAL FIELD

The present invention relates generally to the field of sprayer assemblies for aerosol cans. More particularly, the invention relates to sprayer assemblies having interactive overcaps designed to control access to the means of spraying the contents of the aerosol can.

BACKGROUND ART

The art is generally aware of aerosol can sprayer assemblies adapted to facilitate the actuation of the aerosol can by the hand of the user. Various strategies have been employed to reduce the chance for unintentional spraying of the aerosol can's contents. For example, Crowell, U.S. Pat. No. 3,373,908, shows a substantially unitarily molded sprayer assembly adapted to clip on to the rim of the valve cup of an aerosol can. The button to be pushed by a user in order to spray contents from the can is located within a valley formed in the body of the actuator. The valley and button are so designed that access to the button is limited to objects, such as a user's finger, capable of reaching down into the valley to the button. By this means, access to the button is sufficiently restricted that a flat surface or a rigid object that spans the valley is unable to depress the button and actuate the aerosol can. Nevertheless, objects small enough or so oriented as to reach the button in its valley still can activate the can, making unintentional spraying a possibility.

Demarest et al., U.S. Pat. No. 5,027,982, discloses the use of an overcap that attaches to an actuator, the actuator in turn being attached to the upper chime of an aerosol can. The chime of an aerosol can is the crimped joint at which the dome of the can's lid attaches to the cylindrical sides of the can. The '982 actuator has a button formed at one end of a sprayer arm that has a nozzle at its other end and a channel that communicates between the can's valve stem and the nozzle. The sprayer arm is hinged to the actuator at its nozzle end, allowing a user to actuate the can's valve by depressing the button, moving the sprayer arm downwardly against the valve stem.

The overcap of the '982 device rotates coaxially on the actuator. The overcap has two access ports that a user may align respectively with the button and the nozzle, one port enabling the user's finger to reach the button and the other port allowing spray from the nozzle to escape the overcap when the aerosol can is activated. The overcap may then be turned 90° by the user, whereupon the actuator's button and nozzle are covered by the overcap.

A disadvantage of the '982 device is the attachment of the actuator to the chime of the can. The can's chime is the joint where the can's lid attaches to the sides of the can. The lid of a conventional aerosol can includes a dome. The dome is that part of the can lid that spans the distance between the chime of the can and the crimped joint that defines the rim of the valve cup. The valve cup is the central depression of a typical aerosol can lid, within which the can's valve is located.

The dome typically is fairly flexible, bulging upwardly or retreating downwardly as the relative pressure differential between the contents of the can and the ambient atmosphere changes. The valve cup is carried on the dome and moves with it. This fact makes the distance between the valve of an aerosol can and the structures of a chime-mounted actuator that must engage the valve stem difficult or even impossible to precisely regulate. In extreme instances, over filling or heating a can may cause its dome to bulge upwardly sufficiently far that the valve stem presses against the underside of the actuator and self-activates, causing unintended spraying. At the other extreme, a depressed dome may carry the valve stem sufficiently far away from the underside of the actuator that the can fails to spray, even when a user fully depresses the actuator's button.

Another difficulty with sprayer assemblies that mount on the chime of a can is that can chimes differ in diameter for each size of aerosol can. Different sized sprayer assemblies must be designed specifically to fit each can size. This requires two unique molds and parts inventories for each can size, if a two-part actuator/overcap assembly is being used. In contrast, most conventional aerosol cans, even if differing in overall can and chime diameter, nevertheless are made with standardized valve cups, one valve cup size serving for all. The difference in can diameters is accomplished by the use of larger or smaller can domes, not larger or smaller valve cups and valve structures.

Goncalves, U.S. Pat. No. 4,513,890, discloses a presentation cap that includes a first part that attaches to the valve cup rim and a second part that attaches, in turn, to the first part. The presentation cap serves to correctly orient the can in the user's hand, with the cap's most natural position in the hand causing the nozzle to be directed away from the user. The Goncalves presentation cap does not function to reversibly enclose and reveal its spraying mechanism.

Sette, U.S. Pat. No. 3,844,448, discloses a cam track element that attaches to the valve cup rim and an overcap that attaches to and turns on the cam track element. However, Sette's overcap has cam followers that engage and slide in cam tracks formed in the cam track element, pulling the overcap downwardly on the can as the overcap is turned. When the overcap is locked in a downwardmost location, overcap structures press upon and activate the can's valve to evacuate the contents of the can. Like Goncalves, Sette also does not function to reversibly enclose and reveal the device's spraying mechanism to regulate its availability for use.

A problem repeatedly encountered by the art is that of locking an aerosol can so as to prevent premature or unintended spraying, for example by shoppers in a store. Removable locking inserts have been devised to provide a tamper lock, such as the insert shown in Crowell, U.S. Pat. No. 3,373,908, at 50. Such locking inserts commonly are unitarily molded with a sprayer assembly and must be broken free before the sprayer can be activated. The arrangement is designed to allow a person intending to use the can to remove the locking insert with deliberate but only modest effort. At the same time, accidental bumps in the shipping process will not activate the can, and shoppers attempting to sample the can's contents by way of a quick spray in a store are at least discouraged. Once such a tamper lock has been removed, it usually cannot be replaced. While a tamper lock's undisturbed presence provides immediate assurance that none of a can's contents have been sprayed, such arrangements do not provide ongoing accidental use protection, once the can has been first used.

A need remains for a sprayer assembly that is practical to manufacture and assemble, that will reliably interact with the valve of an aerosol can, avoiding the complications of bulging or depressed can domes, that has major parts usable with conventional aerosol cans of differing diameters, and that provide means to reversibly enclose and expose the spraying structures of the assembly to discourage accidental discharge.

SUMMARY OF THE INVENTION

The present invention is summarized in that an overcap sprayer assembly is provided for use with a conventional aerosol can that has a valve cup with a valve cup rim and a valve having a valve stem. The overcap sprayer assembly includes an actuator and an overcap. The actuator has a body and a sprayer arm. The body includes means for attachment to the valve cup rim of the can. A skirt extends circumferentially around the perimeter of the body and extends upwardly from a lower edge to an upper edge. Interiorly facing surfaces of the skirt define an interior of the body. At least one actuator access port provides access to the interior of the body. The sprayer arm of the actuator has a nozzle adapted to direct spray through an actuator access port. The sprayer arm also includes a socket adapted to engage the valve stem of the aerosol can and a fluid transfer tube communicating between the nozzle and the socket. The sprayer arm is so held within the body that downward force applied to the sprayer arm moves the socket downwardly over the valve stem to activate the valve and expel contents of the can through the nozzle via the fluid transfer tube.

The overcap includes means for attaching the overcap to the skirt of the actuator body in coaxially turning relation thereto. An overcap dome is adapted to extend over and substantially cover the actuator. An overcap wall extends downwardly from the outer margins of the overcap dome, surrounding the actuator body. The overcap also has at least one overcap access port that, by turning the overcap relative to the actuator body, may be moved between an open position, wherein an overcap access port is aligned with the actuator access port through which the nozzle is adapted to direct spray, and a closed position, wherein the overcap wall obstructs the actuator access port.

The method of the invention for manufacturing an assembled overcap sprayer assembly is summarized in that first steps of the method include providing an actuator and overcap generally of the sort just described. The overcap has means for attaching the overcap to the skirt of the actuator body in coaxially turning relation thereto, such means for attaching including at least one overcap undercut projecting inwardly from the direction of the overcap wall toward the actuator skirt. The actuator is further provided with cooperating means formed in the actuator skirt for receiving an overcap undercut of an overcap mounted on the actuator. The overcap undercut is so received in circumferentially sliding relation as to allow the overcap to be turned between its open and closed positions. The cooperating means has an endstop limiting the ability of an overcap being turned toward its closed position to turn beyond the closed position. At least one of the overcap and actuator are made of a resiliently deformable material.

The method of the invention further includes the steps of coaxially orienting the overcap over the actuator and thrusting the overcap and the actuator together until the overcap undercuts are pushed to the level of the cooperating means of the actuator, without reference to the radial alignment of the overcap undercuts and the cooperating means. The overcap then is turned toward the closed position until the overcap undercuts are received by the cooperating means and turned to engage the endstop, whereby the overcap is mounted on the actuator, in the closed position.

BRIEF DESCRIPTION OF THE DRAWINGS

FIG. 10 is a cross-sectional view taken along section lines 10—10 of FIG. 9, with the lock member shown in solid in its locked position and shown in phantom in its unlocked position, and with an aerosol can shown in phantom.

FIG. 11 is a perspective view of the overcap sprayer assembly of FIG. 2 with the overcap in the closed position and including a tamper indicator, and with features of the actuator and the removed tamper indicator shown in phantom.

DETAILED DESCRIPTION OF THE PREFERRED EMBODIMENT

Figure 1:
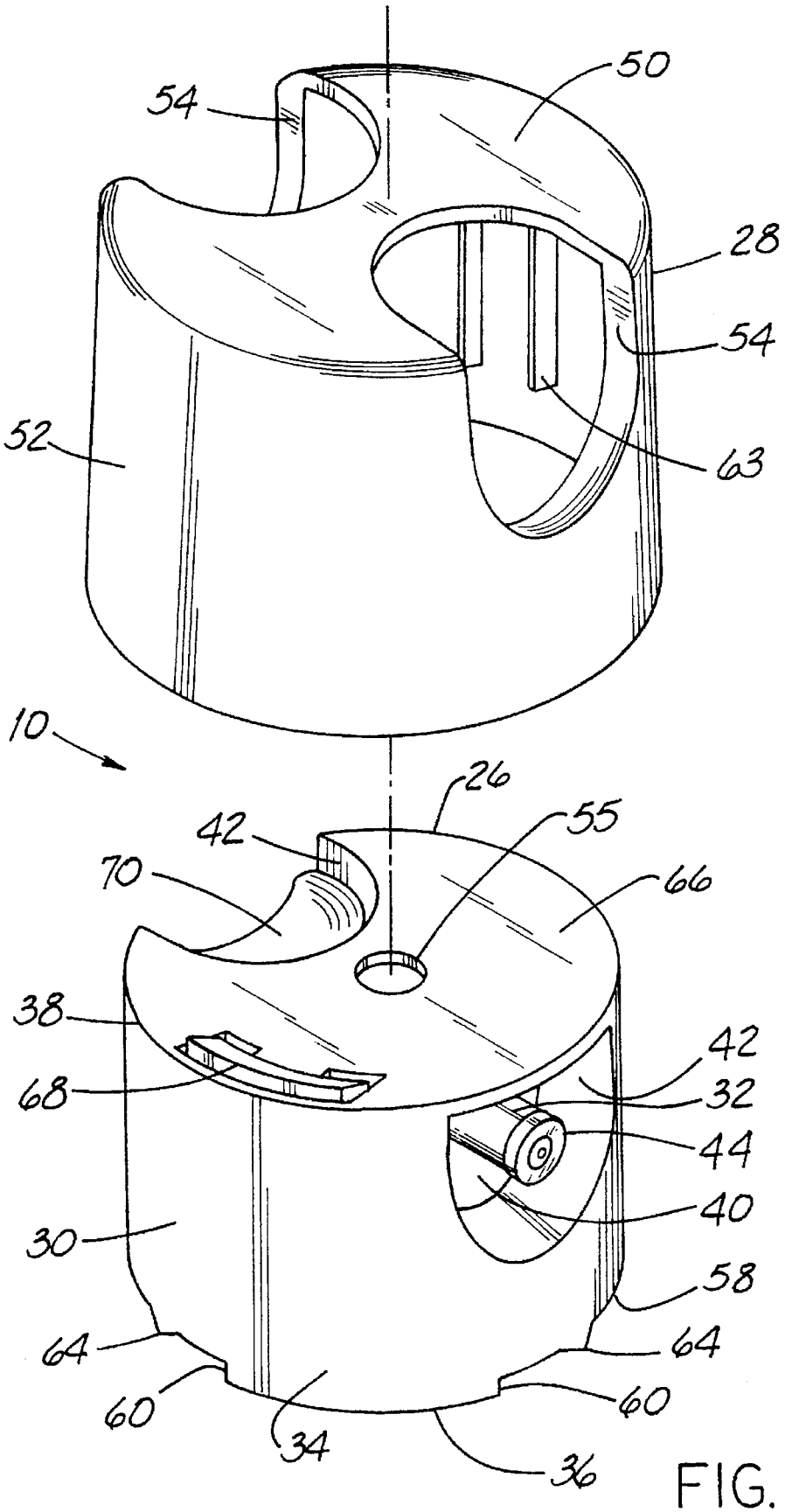
FIG. 1 is a front perspective view of the preferred embodiment of the overcap sprayer assembly of the invention, with the overcap disassembled from the actuator.
Figure 2:
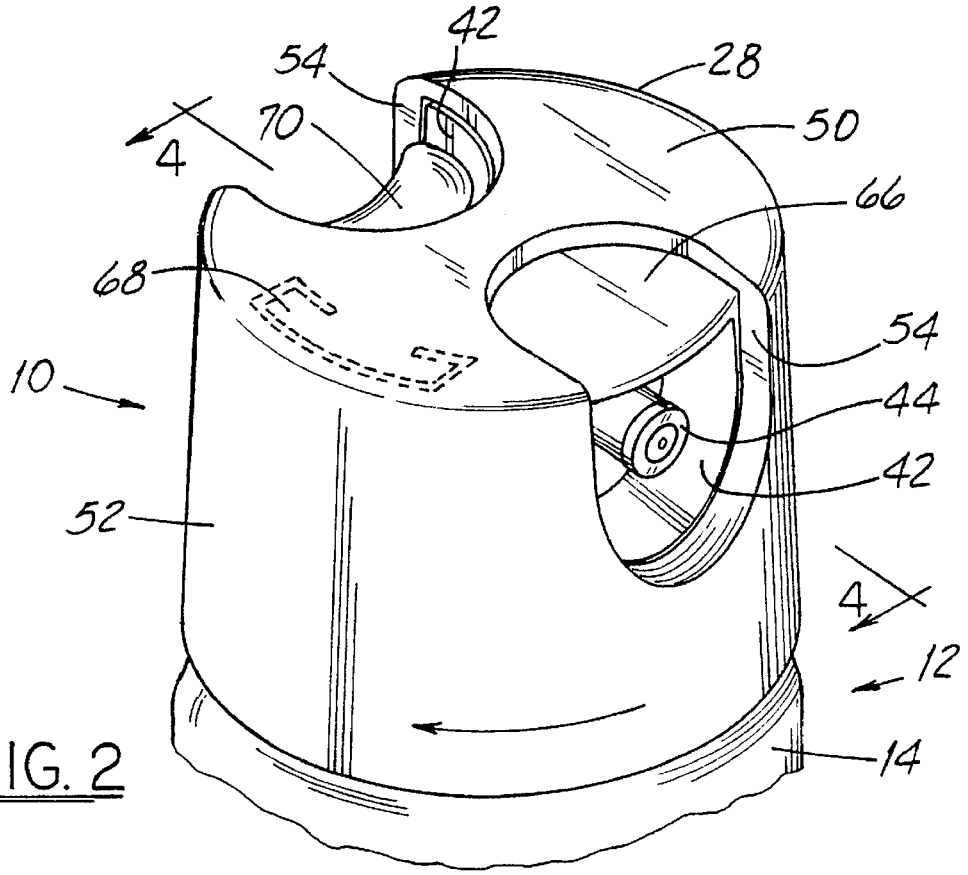
FIG. 2 is a front perspective view of the preferred embodiment of the overcap sprayer assembly of the invention mounted on an aerosol can and with the overcap in the open position.
Figure 3:
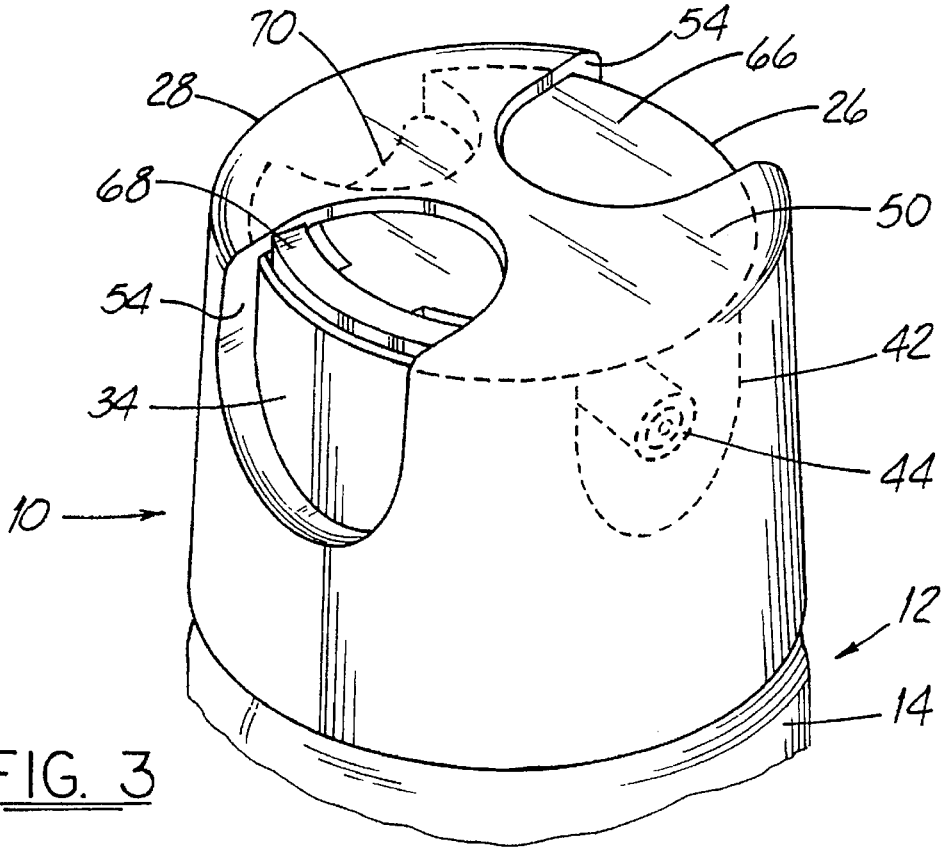
FIG. 3 is a perspective view of the overcap sprayer assembly of FIG. 2, with the overcap in the closed position.

Turning now to the drawings, wherein like parts are indicated by like reference numbers, a first and preferred embodiment of the overcap sprayer assembly of the invention is shown generally in FIGS. 1–3 at 10.

The overcap sprayer assembly 10 is designed for use with a conventional aerosol can, such as that shown generally in FIG. 2 and elsewhere at 12. With reference to parts best seen in FIG. 4, the aerosol can 12 has a can body 14 and a can lid 16. The can body 14 is joined to the can lid 16 by a joint crimped to create a can chime 18. In the can shown at 12, the point of attachment of the can lid 16 to the top of the can body 14 is necked in slightly so that the can chime 18 lies within the maximum circumference of the can body 14. Although such a necked-in arrangement is preferred, the overcap sprayer assembly of the invention is not limited to use with a necked-in can chime. The can lid 16 of the conventional aerosol can 12 further includes a can dome 19, extending inwardly from the can chime 18 toward the longitudinal axis of the can. A valve cup 20 is mounted on the can dome 19. The valve cup 20 has a valve cup rim 22 and a valve (not visible) having a valve stem 24. The valve is designed to be opened by movement of the valve stem 24 downwardly, in a generally axial direction. All of these conventional aerosol can features are well known in the art.

With reference especially to FIGS. 1–7, the overcap sprayer assembly 10 of the invention has an actuator 26 and an overcap 28. The actuator 26 has a body 30 and a sprayer arm 32. The body 30 of the actuator 26 has means for attachment to the valve cup rim 22. In the preferred embodiment shown, the body 30 includes a generally cylindrical actuator attachment member 31 extending downwardly, parallel to the longitudinal axis of the actuator 26. The actuator attachment member 31 is readily seen in FIGS. 4 and 5. The actuator attachment member 31 is hollow and so formed as not to interfere with the movement and operation of the sprayer arm 32, which is discussed below, and has an interior diameter slightly larger than that of the valve cup rim 22.

Retention clips 33 extend inwardly from the attachment member 31 sufficiently far that, when the attachment member is thrust downwardly over the valve cup rim 22, the retention clips snap over the valve cup rim to hold the actuator 26 in place on the can 12. The retention clips 33 shown and preferred extend generally circumferentially on the attachment member 31 for short distances, requiring that the means for attachment of the actuator 26 to the valve cup rim 22 include at least two, generally opposed retention clips to secure the actuator to the valve cup rim 22. However, alternative means for attachment will be apparent to those skilled in the art and are within the breadth and scope of the invention, including a single retention clip that extends entirely around the attachment member 31, structures extending downwardly from the body 30 to engage inside surfaces of the valve cup rim 22, and the like.

The attachment member 31 is made of conventional materials sufficiently resilient to allow the temporary distortion of the attachment member necessary for the preferred retention clips 33 to be snapped over the valve cup rim 22. Stop ribs 35, clearly seen in FIG. 5, extend inwardly from the attachment member at a location spaced above the retention clips 33. The stop ribs 35 are seated on the upwardly presented surfaces of the valve cup rim 22, when the actuator 26 is in place on the can 12. By coaction of the stop ribs 35 and retention clips 33, the actuator 26 is located precisely on the valve cup rim 22, with the sprayer arm 32 at a reliably predictable distance above the valve stem 24. The attachment member 31, retention clips 33, and stop ribs 35 thus are an example of the actuator body's means for attachment to the valve cup rim 22 of the invention, although alternative arrangements within the breadth and scope of the invention will be apparent to those skilled in the art.

The body 30 further includes a skirt 34 that extends circumferentially around the perimeter of the body, extending upwardly from a lower edge 36 to an upper edge 38. The skirt 34 thus has interiorally facing surfaces that define a body interior 40. The sprayer arm 32 preferably is substantially contained within the body interior 40. At least one actuator access port 42 is formed in the body 30 and provides access to the body interior 40.

Figure 4:
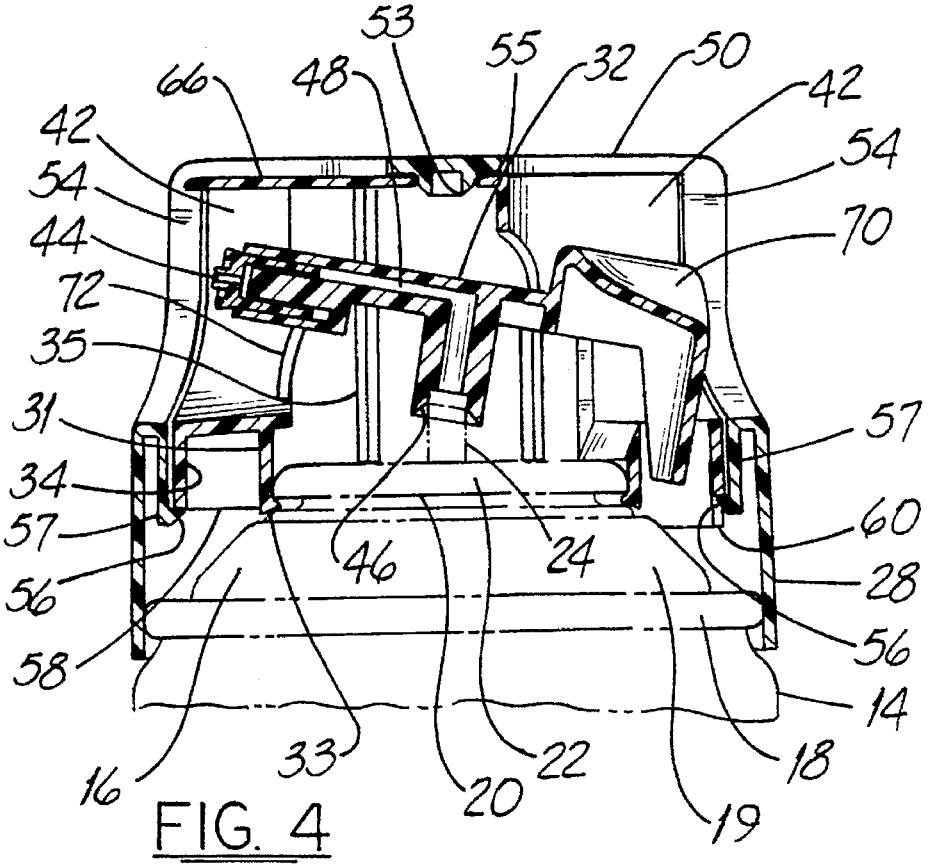
FIG. 4 is a cross-sectional view taken along section line 4—4 of FIG. 2, with the sprayer arm of the actuator depressed.
Figure 5:
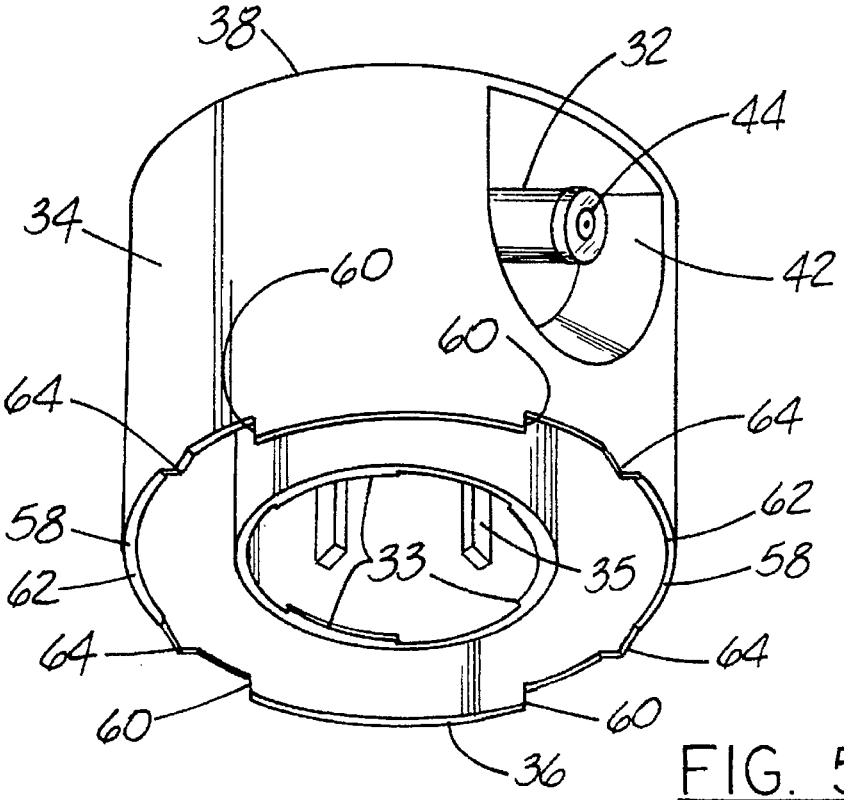
FIG. 5 is the actuator of the overcap sprayer assembly of FIG. 2, shown in perspective from beneath.
Figure 6:
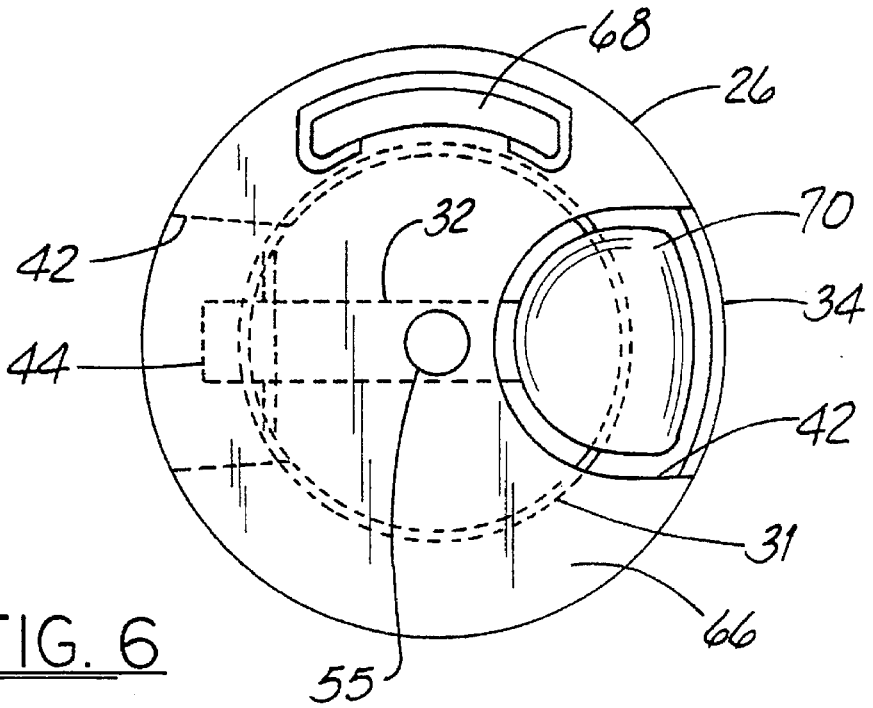
FIG. 6 is a top plan view of the actuator of FIG. 5, with certain interior structures shown in phantom.

The sprayer arm 32, shown clearly in cross section in FIG. 4, has a nozzle 44 adapted to direct spray through an actuator access port 42. The sprayer arm 32 includes a socket 46 adapted to engage the valve stem 24 of the aerosol can 12. The sprayer arm 32 further includes a fluid transfer tube 48 that communicates between the nozzle 44 and the socket 46 in generally fluid-tight relation. The sprayer arm 32 shown in the drawings extends almost the width of the body 30 and is adapted to direct spray laterally, with respect to the longitudinal axis of the can 12. However, sprayer arms of any shape directing spray in any desired direction are within the scope and breadth of the invention.

As is illustrated in FIG. 4, the sprayer arm 32 preferably is attached to the body 30 in hinged relation such that downward force applied to the sprayer arm moves the socket 46 downwardly over the valve stem 24 to activate the valve and release contents of the can 12 through the nozzle 44 via the fluid transfer tube 48. However, it is known in the art to allow such structures as the sprayer arm to move within a channel or other means for controlling the position and movement thereof, without the sprayer arm being fixedly attached to the body 30 in any way. All such alternative means for holding the sprayer arm within the body 30 to control its position and movement are within the scope and breadth of the invention.

In the preferred embodiment of the overcap sprayer assembly of the invention, the overcap 28 has means for attaching the overcap to the skirt 34 of the actuator body 30 in coaxially turning relation thereto. The overcap 28 has an overcap dome 50 adapted to extend over and substantially cover the upwardly facing surfaces of the actuator 26. An overcap wall 52 extends downwardly from the outer margin of the overcap dome 50, substantially surrounding the body 30 of the actuator 26. The overcap 28 includes at least one overcap access port 54. A user may coaxially turn the overcap 28 on the actuator body 30, moving the overcap access port 54 between an open position, wherein an overcap access port is aligned with the actuator access port 42 through which the nozzle 44 is adapted to direct spray, and a closed position, wherein the overcap wall 52 obstructs that actuator access port. The open position is illustrated in FIG. 2, and the closed position is illustrated in FIG. 3.

In the embodiment of the invention shown in FIG. 4, the underside of the overcap dome 50 has a centrally located, downwardly extending locator pin 53 adapted to be received in turning relation within an upwardly open locator pin socket 55, formed in the body 30. Although this arrangement has advantages in that it securely locates the overcap 28 on the body 30, it is not an essential feature.

Figure 7:
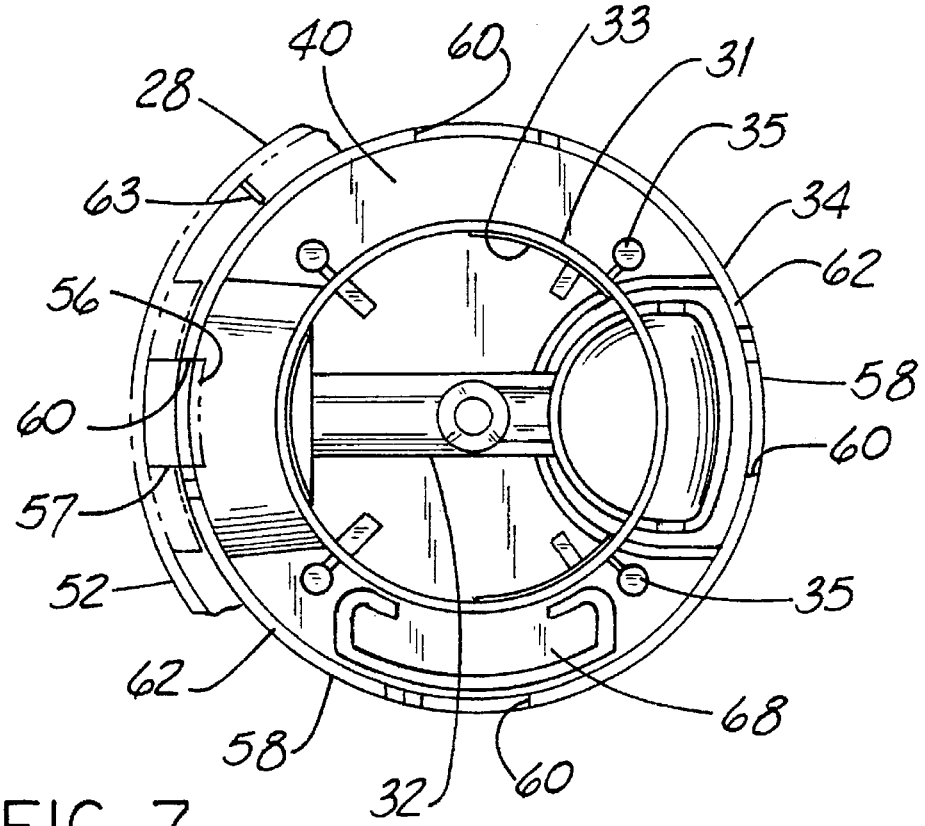
FIG. 7 is a bottom plan view of the actuator of FIG. 5, with a broken away portion of the overcap shown in phantom.

In the preferred embodiment of the overcap sprayer assembly shown at 10, the means for attaching the overcap 28 to the skirt 34 of the actuator body 30 includes at least one circumferentially extending overcap undercut 56, best seen in FIGS. 4 and 7. The overcap undercut 56 projects inwardly from the direction of the overcap wall 52 toward the actuator skirt 34, when the overcap 28 is in place on the actuator 26. The overcap undercut 56 may project directly from the overcap wall 52. Alternatively and preferably, the overcap undercut 56 projects inwardly from a separate overcap attachment member 57 that extends generally parallel to and within the circumference of the overcap wall 52, as is illustrated in FIG. 4.

Cooperating means for receiving the overcap undercut 56 is formed in the actuator skirt 34, the cooperating means receiving the overcap undercut in circumferentially sliding relation. Such cooperating means may be a groove, a channel, or the like. However, as is shown in FIGS. 4 and 7, in the preferred embodiment of the invention shown at 10, the cooperating means formed in the actuator skirt 34 for receiving the overcap undercut 56 includes at least one skirt notch 58 extending circumferentially in the lower edge 36 of the actuator skirt 34. The skirt notch 58 terminates at end walls 60, one at each end of the skirt notch. When the overcap 28 is turned either to its open position or its closed position, at least one overcap undercut 56 stops against a skirt notch end wall 60, preventing further turning.

If the skirt notch 58 is downwardly open, as is illustrated in the embodiment of the invention shown in FIGS. 4 and 7, the overcap sprayer assembly also includes means for maintaining a minimum vertical separation of the overcap 28 over the actuator 26, to keep each overcap undercut 56 securely engaged within a skirt notch 58. Although various such means for maintaining a minimum vertical separation are possible and are within the breadth and scope of the invention, the simplest expedient is to precisely mold the overcap 28 and actuator 26 so that the underside of the overcap dome 50 is in actual contact with the uppermost structures of the actuator when the overcap is mounted on the actuator with each overcap undercut 56 engaged in skirt notch 58.

The skirt notch 58 has a notch floor 62 against which surfaces of the overcap undercut 56 slide as the overcap 28 is turned relative to the actuator 26. Preferably the notch floor 62 includes detents 64, preferably formed as notches in or bumps or projections on the notch floor, as is seen clearly in FIGS. 5 and 7. The overcap undercut 56 is then adapted to travel over the detents with resistance sufficient to require at least a user's deliberate action to move the overcap undercut over the detents. The detents 64 are so located as to tend to retain the overcap 28 in its open or closed positions.

The preferred method for manufacturing the overcap 28 is to mold it unitarily out of a suitable plastic, using a conventional two-part mold. Such molds have two mating halves, usually designated the mold's "cavity" and its "core," with the cavity forming primarily the outer surfaces and the core the inner surfaces of the molded object. With the mold closed, the space between the mating halves is filled with plastic to form the object. Then the mold is opened. If the molded object does not spontaneously drop free of the mold, it is pulled or stripped from the half of the mold to which it still adheres.

Features of molded objects can present difficulties if they extend laterally with respect to the direction in which the molded object is to be removed from the mold. The overcap undercut 56 is an example of such a potentially problematic feature. One-piece mold cores or cavities are simpler and more economical to manufacture and operate than are multi-part mold cores or cavities. But to allow a one-piece mold core, for example, to be extracted from a molded object, the molded object must usually never pinch or project inwardly, as one moves from the depth of the interior of the molded object to its open end. Instead, the interior of a molded object should rather, at the least, have parallel walls and preferably slightly conical or outwardly expanding walls.

Unless it is designed to temporarily distort outwardly as a mold core is removed, an undercut structure that is formed by a groove or indentation of some sort in the mold core is impacted. Such undercut structures tend to hold the molded object firmly to the mold core, making difficult removal of the object without damage to it. An undercut structure presents even greater difficulties when its impacting surface is intended in use to mate with a notch or the like in another object and to not be easily pulled out of it. In essence, the same physical characteristics that cause a feature such as an overcap undercut 56 to securely retain the overcap 28 on the actuator 26 by engaging a structure such as the notch floor 62 of a skirt notch 58 also will hold the molded overcap securely on a mold core, interfering with manufacturing.

To address this difficulty, in the preferred overcap 28 of the invention, an overcap access port 54 is located over each overcap undercut 56 and extends radially for a selected distance from the outer margin of the overcap dome 50, toward the overcap dome's center. By this means, the upwardly facing surfaces of each overcap undercut 56 may be formed by a mold element that extends from the mold cavity downwardly when the mold is closed, through the associated overcap access port 54. By this means, such upwardly facing surfaces may be designed to securely engage the notch floor 62, to resist removal of the overcap 28 once it is in place on the actuator 26. In the preferred embodiment, an overcap attachment member 57 is located beneath each overcap access port 54 and not elsewhere, avoiding the expenditure of plastic that would be necessary if the overcap attachment member 57 were to extend without interruption around the entire overcap 28. In such an arrangement, it is beneficial that the overcap 28 include spacer lugs 63 that extend inwardly for a selected distance from the overcap wall 52 to maintain a consistent separation between all parts of the overcap wall and the skirt 34 of the actuator 26.

The overcap detents 64, as described above, tend to retain the overcap 28 in its open and closed positions. However, it is desirable that the overcap 28 be more securely locked in its closed position, so as to provide some degree of additional protection against accidental activation of the aerosol can. Therefore, in the preferred embodiment of the invention, at least one of the actuator body 30 and the overcap 28 has a locking port and the other of the actuator body and the overcap has lock member that is adapted to project into and engage the locking port. The lock member has an unlocked position wherein it is not engaged in an opposed locking port, allowing the overcap 28 to turn freely upon the actuator body 30. The lock member also has a locked position assumed when the lock member becomes aligned with an opposed locking port, projecting and preferably aggressively snapping thereinto to engage the opposed locking port and resist further overcap turning. Preferably the lock member is of a size and location such that an opposing access port may serve as a locking port. The use of an opposing access port as the locking port is preferred for the simplicity of design achieved, and the embodiments of the invention disclosed below all are so designed.

If the lock member is sufficiently secure in the opposed locking port, subsequent attempts to turn the overcap either further or back toward the open position merely will rotate the entire overcap sprayer assembly on the can 12. By this arrangement, a person who gives the overcap 28 a twist is prevented from accidentally activating the aerosol can or from damaging the lock member or other structures of the overcap sprayer assembly by attempting to force the overcap 28 to turn before the lock member has been moved to its unlocked position.

A number of alternative embodiments of the lock member are possible. For example, the lock member may extend from the actuator body 30 and be biased outwardly therefrom so as to snap into an opposed overcap access port 54, serving as the locking port. The embodiment of the overcap sprayer assembly shown at 10 is an example of such an arrangement. The body 30 of the actuator 26 of the embodiment shown at 10 includes an actuator dome 66. The actuator dome 66 extends inwardly toward the longitudinal axis of the actuator from the skirt upper edge 38 to substantially cover the interior 40 of the actuator body 30. Alternatively expressed, the actuator dome 66 substantially bridges over and covers the uppermost end of the cylindrical skirt 34.

In the embodiment of the overcap sprayer assembly shown at 10, and referring to FIGS. 1–3, the overcap access port 54 is formed at least in part in the overcap dome 50. A lock member 68 extends and is biased upwardly from the actuator dome 66, toward the underside of the overcap dome 50, and is engagable in the overcap access port 54. The lock member 68, when in its locked position and engaged in the overcap access port 54, must be pushed downwardly to an unlocked position sufficiently depressed that the overcap dome 50 may be slipped over the lock member, allowing the overcap 28 to be turned toward its open position. In FIG. 3, the lock member 68 is shown in its locked position, with the nozzle 44 and other parts of the actuator 26 shown in phantom, covered by the overcap wall 52 and the interior 40 of the actuator body 30 being closed from above by the actuator dome 66. Thus, in FIG. 3, the lock member 68 projects upwardly from the actuator dome 66 into an opposed overcap access port 54, and is engaged within the overcap access port, preventing the rotation of the overcap 28.

In contrast, FIG. 2 shows the overcap 28 turned to its open position, exposing the nozzle 44. The lock member 68 has been depressed so as to slip under the overcap dome 50, and is shown in phantom. As is shown in FIG. 2, the actuator dome 66 preferably extends over the nozzle 44, helping to prevent unintentional user contact with the nozzle from above.

The overcap sprayer assembly 10 may have only one actuator access port 42 and one corresponding overcap access port 54. However, it is preferred that the sprayer arm 32 include a finger button 70 located at a point on the sprayer arm remote from the nozzle 44, and preferably on the end of the sprayer arm remote from the nozzle. It is then preferred that the actuator 26 include at least two actuator access ports 42 so located in the body 30 of the actuator that the nozzle 44 is directed toward a first actuator access port while the finger button 70 is accessible through the second actuator access port. In such an arrangement, the sprayer arm 32 is most conveniently attached to the actuator body 30 by means of a living hinge, such as that shown at 72 in FIG. 4, located near the nozzle end of the sprayer arm 32.

It is then preferred that the overcap 28 include at least two overcap access ports 54 so located that an overcap access port is aligned with each of the first and second actuator access ports 42 when the overcap 28 is in its open position. The two overcap access ports 54 may differ from each other in appearance or shape, with, for example, the overcap access port through which the finger button 70 is accessed being larger or otherwise visually or tactilely distinctive to help a user immediately identify it. However, there are important assembly considerations, discussed below, that make identical overcap access ports 54 advantageous. As is clearly shown in FIG. 2, it is preferred that the actuator dome 66 not be extended over the finger button 70, both to ease user access to the finger button and also to make the finger button location visually distinguishable from the location of the nozzle 44, even with identical overcap access ports 54.

Figure 8:
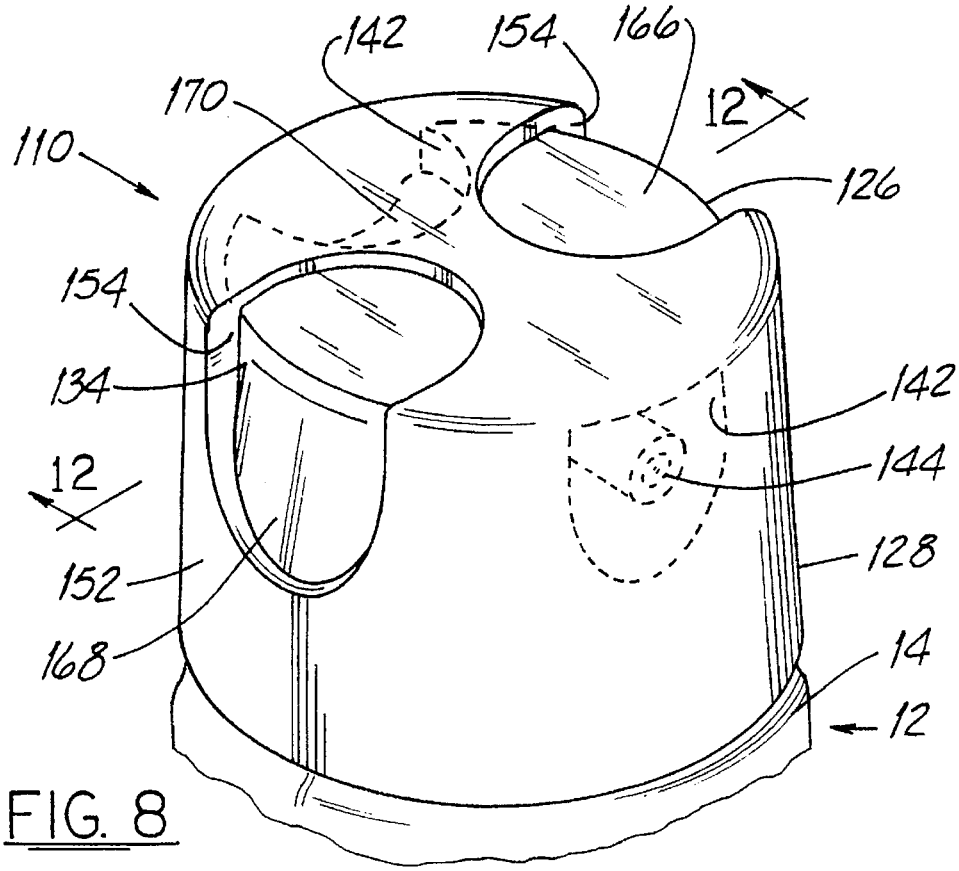
FIG. 8 is a perspective view corresponding to FIG. 2 of a second embodiment of the overcap sprayer assembly of the invention, with certain features of the actuator shown in phantom.
Figure 12:
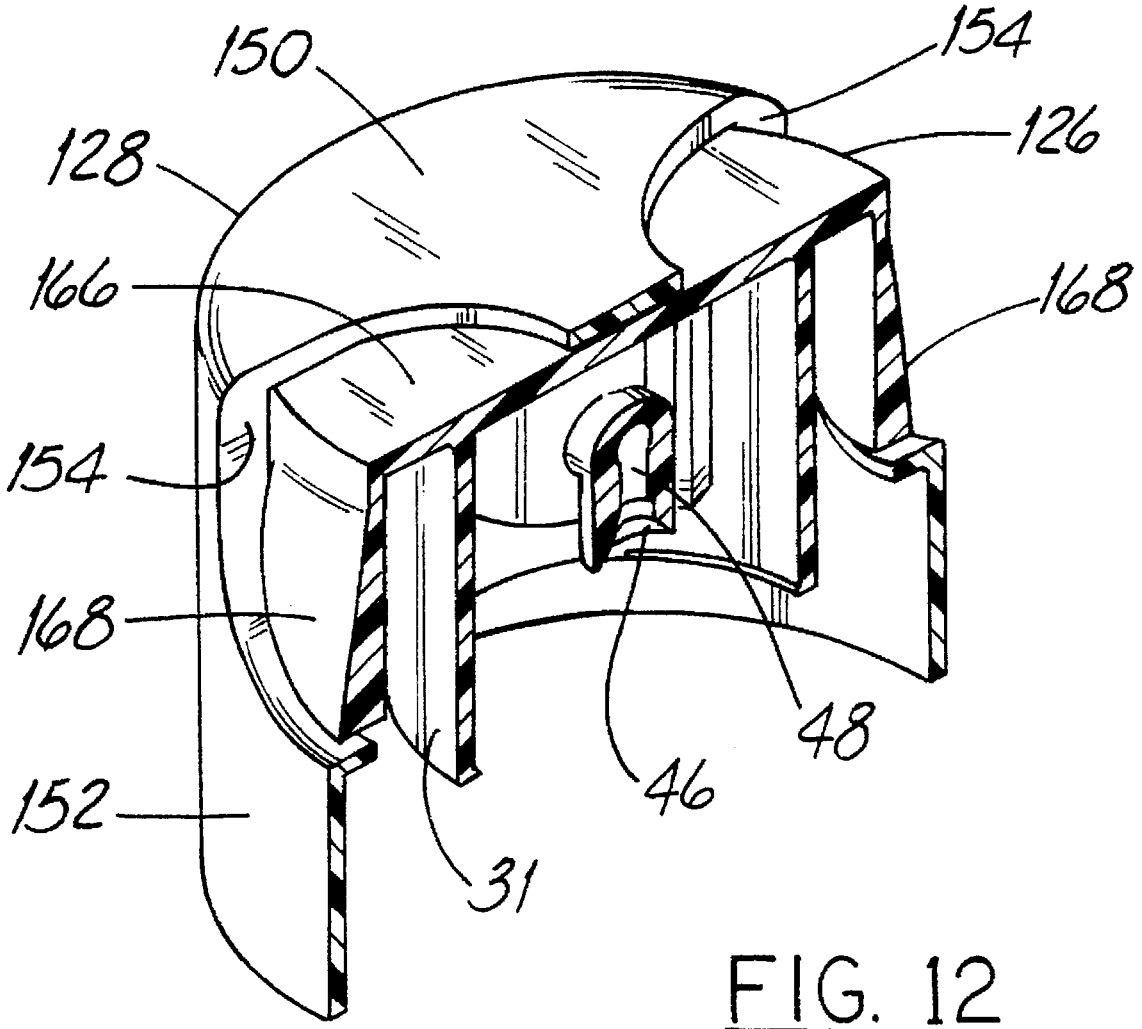
FIG. 12 is a cross-sectional view of the overcap sprayer assembly of FIG. 8, taken along section lines 12—12 of FIG. 8.

A second embodiment of the overcap sprayer assembly of the invention is shown at 110, generally in FIG. 8 and in cross section in FIG. 12. Features directly corresponding to features of the embodiment shown at 10 that have already been described and given reference numbers shall be given corresponding reference numbers increased by 100.

In the embodiment of the overcap sprayer assembly shown at 110, the overcap access port 154 is formed at least in part in the overcap wall 152. A lock member 168 extends and is biased outwardly from the actuator skirt 134. By this means, the lock member 168, when in its locked position and engaged in an overcap access port 154, must be moved to its unlocked position by being pushed radially toward the longitudinal axis of the actuator 126. When so moved sufficiently that the lock member 168 may slip under the overcap wall 152, the overcap 128 may be turned toward its open position.

It is preferred that the embodiment of the overcap sprayer assembly shown at 110 include a finger button 170 and two actuator access ports 142 alignable with two overcap access ports 154, in the manner disclosed above with respect to the finger button 70 and two actuator access ports 42 and overcap access ports 54, discussed above with respect to the embodiment of the invention shown at 10. It is then preferred that there be two lock members 168 of the form disclosed above, each lock member being adapted to engage one of the two overcap access ports 154 when the lock members are in their locked positions. This arrangement is best shown in FIG. 12.

When two lock members 168 are used, they must be moved to their unlocked positions by being simultaneously pinched inwardly toward the longitudinal axis of the actuator 126 before the overcap 128 may be turned toward its open position. Such a pinching action with respect to many common aerosol can sizes requires more strength and larger hands than does the manipulation of a single lock member.

Figure 9:
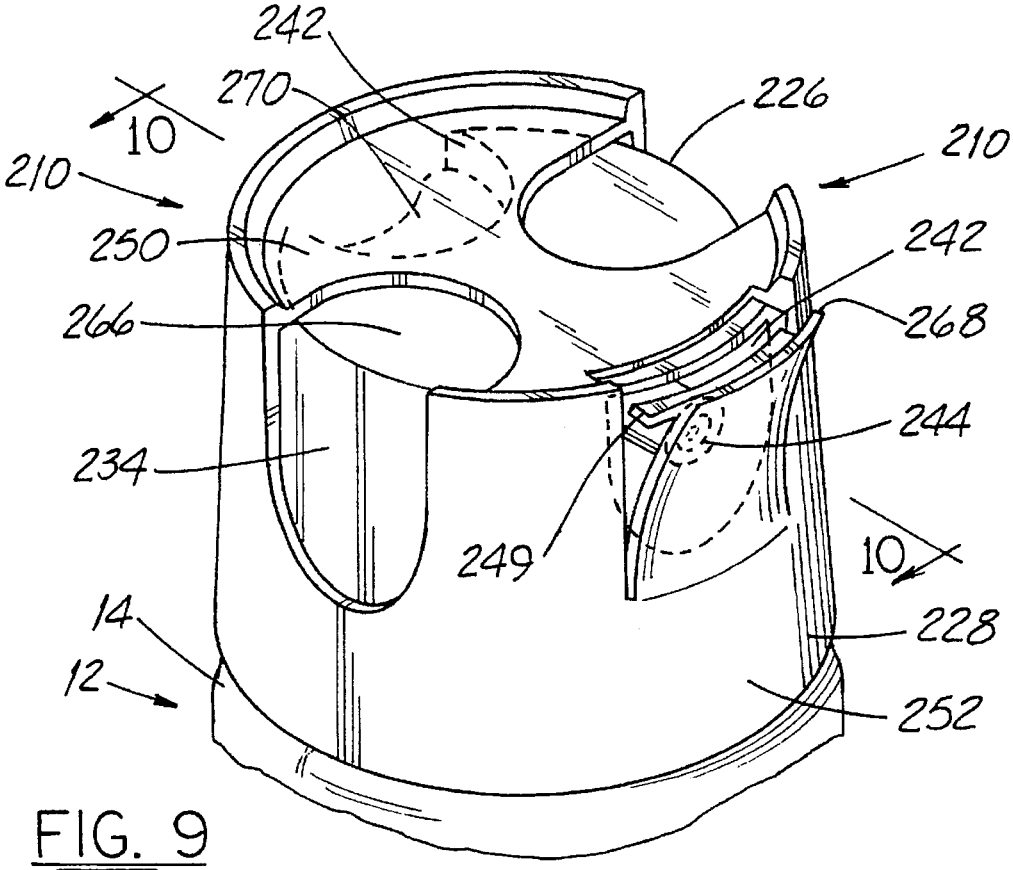
FIG. 9 is a perspective view corresponding to FIG. 2 of a third embodiment of the overcap sprayer assembly of the invention, with certain features of the actuator shown in phantom.

A third embodiment of the overcap sprayer assembly of the invention is shown generally in FIG. 9 at 210. Features directly corresponding to features of the embodiments shown at 10 and 210 that have already been described and given reference numbers shall be given corresponding reference numbers beginning at 200.

In the embodiment of the overcap sprayer assembly shown at 210, the lock member 268 extends from the overcap 228 and projects inwardly therefrom when the overcap 228 is in the closed position, toward the body 230 of the actuator 226. Preferably the lock member 268 extends from the overcap wall 252, as is shown in FIG. 9, and extends radially and inwardly toward the actuator 226. The lock member 268 has a projecting tab 249 adapted to extend within and engage an actuator access port 242 when aligned therewith, assuming a locked position that interferes with attempts to turn the overcap 228. A user must push or pull the lock member 268 outwardly to move it from its locked position, with its projecting tab 249 engaged in an actuator access port 242, to its unlocked position, wherein the projecting tab is sufficiently withdrawn from the actuator access port as to allow the overcap 228 to be turned.

Although the location of the lock member 268 in the overcap wall 252 just described is that which is preferred for the embodiment of the invention shown at 210, it is apparent that the lock member alternatively could be located in the overcap dome 250 and extend downwardly therefrom when the overcap 228 is in its closed position, toward the actuator 226, to engage an actuator access port 242, from above. Such an arrangement would require a user to pull or push the lock member upwardly to move it from its locked position to its unlocked position.

In all of the embodiments of the invention disclosed above, the actuator 26 is mounted on the valve cup rim 22. This arrangement is preferred for several reasons. As is dealt with in the Background Art discussion, above, a conventional valve cup 20 of an aerosol can 12 is a relatively rigid structure that does not flex significantly with variations in the pressure differential between the interior of the aerosol can and the surrounding atmosphere. Instead, the can dome 19 tends to flex more readily and be responsible for most movement of the can lid 16 with change in the pressure differential. Actuators 26 attached to the valve cup rim 22 relate more predictably and reliably to the valve stem 24, simply because the region of the can lid 16 between their point of attachment to the can 12 and the valve stem has a stable geometry under a wide variety of pressure conditions.

Furthermore, it is common to manufacture aerosol cans 12 having different diameters of can bodies 14 but all using in common a valve cup 20 having a standard size, making up the differences in can diameter by varying the diameter of the can dome 19. Therefore, if the actuator attaches to the valve cup rim 22, a single size of actuator may be used with overcaps 28 of varying diameters, each overcap being adapted to mount on the one-size actuator by having, for example, a single size of overcap attachment member 57 but having overcap walls 52 of diameters selected to match the diameter of the can body 14 with which the overcap is to be used. By this means, a manufacturer dealing with products appearing in different sized cans can nevertheless rely on a single mold and single parts inventory for all of the actuators 26 needed for the entire operation.

Different molds and parts inventories are required only for overcaps 28 having different diameters. When compared to custom designing an actuator 26, custom designing the structurally simpler overcap is relatively simple, and the part is easy to mold quickly. Thus, different can sizes may be accommodated merely by repeating the easier and cheaper part of the design and manufacturing task. The more demanding actuator design and mold-making task need be done only once.

Although attachment to the valve cup rim 22 is preferred for these reasons, and the design of the actuator 26 disclosed above would allow such attachment, in combination with the described interaction with the overcap 28 disclosed, many of the advantages of the overcap sprayer assembly of the invention can be realized with an actuator adapted to attach to the can chime 18, in the manner of the actuator shown in U.S. Pat. No. 5,207,982. In particular, the advantages of all of the embodiments of the lock members 68, 168, 268 described may be obtained without reference to the exact location of attachment of the actuator to the aerosol can.

It is preferred that the overcap sprayer assembly of the invention include a tamper indicator, such as the tamper indicator 74 shown in FIG. 11 attached to the overcap 28 in break-free relation. Although the embodiment of the overcap sprayer assembly illustrated in FIG. 11 is the embodiment shown at 10 of FIG. 2, the tamper indicator would be as appropriate with all of the embodiments of the invention disclosed. The tamper indicator 74 is adapted to close the overcap access port 54 sufficiently to prevent operation of the actuator 26 before removal of the tamper indicator from the overcap 28. If, as is preferred, the actuator body 30 has a lock member 68 that is adapted to project into and engage an opposed overcap access port 54, it is preferred that the tamper indicator 74 be adapted to block movement of the lock member to its unlocked position without prior removal of the tamper indicator from the overcap 28.

The actuator 26 and overcap 28 both preferably are molded by conventional methods and means out of conventional plastics well known in the art as suitable for such objects. Although a mold design strategy with respect to certain surfaces of the overcap undercuts 56 has been discussed, above, the invention should not be understood as limited to structures that permit or that have been made from molds designed in accordance with that strategy.

The rapid and reliable assembly of multi-part objects such as overcap sprayer assemblies presents challenging problems of part manipulation and orientation. These problems are exacerbated by attempts to automate assembly. The manufacture the overcap sprayer assembly of the invention, for example, requires that the overcap 28 be so manipulated prior to mounting on the actuator 26 that the overcap is right side up over the actuator 26 and axially in line with it. If it is also necessary that the overcap 28 and actuator 26 be radially aligned so that the correct overcap access port 54 mounts over the correct actuator access port 42, for example, or so that the overcap undercuts 56 are aligned with the skirt notches 58, automated assembly becomes importantly more difficult.

The structures of the overcap sprayer assembly of the invention, in all the embodiments shown, are designed to avoid the need for such radial alignment prior to the mounting of the overcap 28 to the actuator 26. When made of preferred materials, the overcap 28 and actuator 26 are capable of slight resilient flexing and distortion. Consequently, if the overcap access ports 54 are identical, as is preferred, the overcap 28 may be thrust down over the actuator 26, without regard to radial alignment of parts. The overcap undercuts 56, should they by chance be located over skirt notches 58, simply snap into place. The overcap 28 may then be turned toward the locked position until an overcap undercut 56 stops against a skirt notch end wall 60, completing the assembly procedure, with the overcap in the closed position.

Should the overcap undercuts 56 first be located over a part of the lower edge of the skirt 34 where no skirt notch 58 extends, the overcap 28 simply flexes outwardly slightly and/or the actuator 26 flexes inwardly, to accommodate the overcap undercuts. The overcap 28 may then be turned toward the locked position until each overcap undercut 56 first encounters and snaps into a skirt notch 58 and then proceeds to stop against a skirt notch end wall 60, again completing the assembly procedure. If a locking member 68 is present, it automatically engages an opposing access port upon its first opportunity to do so, which will be when an overcap undercut 56 stops against a skirt notch end wall 60, with the overcap 28 in its closed position.

The method of the invention for manufacturing an assembled overcap sprayer assembly includes the step of providing an actuator and an overcap, at least one and preferably both of which are molded of a resiliently deformable material. The actuator and overcap preferably are designed in accord with the disclosure above. Minimally, referring by way of example only to the embodiment of the overcap sprayer assembly shown at 10, the actuator 26 has a body 30 and a sprayer arm 32. The body 30 has a skirt 34 that extends circumferentially around the perimeter of the body and extends upwardly from a lower edge 36 to an upper edge 38, with interiorly facing surfaces of the skirt defining an interior 40 of the body. The skirt 34 has at least one actuator access port 42 providing access through the skirt to the interior 40 of the body 30. The sprayer arm 32 is located substantially within the interior 40 of the body 30 and has a nozzle 44 adapted to direct spray outwardly, through an actuator access port 42.

The overcap 28 is adapted to be mounted on the actuator 26. The overcap 28 has an overcap dome 50 adapted to extend over and substantially cover the actuator 26, when the overcap is mounted on the actuator. An overcap wall 52 extends downwardly from the outer margins of the overcap dome 50. The overcap 28 also includes at least one overcap access port 54 that, by turning the overcap relative to the actuator 26 when the overcap is mounted on the actuator body 30, may be moved between an open position, wherein an overcap access port is aligned with the actuator access port 42 through which the nozzle 44 is adapted to direct spray, and a closed position, wherein the overcap wall 52 obstructs the actuator access port.

The overcap 28 also includes means for attaching the overcap to the skirt 34 of the actuator body 30 in coaxially turning relation thereto, such means for attaching including at least one overcap undercut 56 projecting inwardly from the direction of the overcap wall 52 toward the skirt. The actuator 26 is further provided with cooperating means formed in the actuator skirt 34 for receiving an overcap undercut 56 of an overcap 28 mounted on the actuator, the overcap undercut being received in circumferentially sliding relation to allow the overcap to be turned between its open and closed positions. The cooperating means has an endstop, of which the skirt notch end walls 60 are an example, the endstop limiting the ability of an overcap 28 being turned toward its closed position to turn beyond the closed position. At least one and preferably both of the overcap 28 and actuator 26 are made of a resiliently deformable material.

The method of the invention further includes the step of coaxially orienting the overcap 28 and the actuator 26, with the upper edge 38 of the skirt 34 presented toward the overcap. Such a presentation shall be described as placing the overcap 28 "over" the actuator 26, without regard to the actual orientation of the longitudinal axes of the overcap and actuator to the earth. The overcap 28 and actuator 26 are then thrust together until the overcap undercuts 56 are pushed to the level of the cooperating means of the actuator. This is done without reference to the radial alignment of the overcap undercuts 56 and the cooperating means. The overcap 28 then is turned relative to the actuator toward the closed position until the overcap undercuts 56 are received by the cooperating means, if they are not already engaged in the cooperation means. The overcap 28 is then turned further to engage the endstop, whereby the process of manufacture and assembly is compete, with the overcap mounted on the actuator 26, in the closed position.

The method of the invention achieves important savings and advantages. The method does not require custom orientation machinery on the production line that otherwise would be necessary to separately handle and locate the actuator and the overcap in a predetermined position for assembly. Such machinery is extremely expensive so that, as a benefit of the practice of the method of the invention, less investment is required for capital equipment. Furthermore, the machinery and component design that still is required is less complex, with a consequent reduced cost and likelihood of failure. The relative simplicity of machinery design and component handling allows faster assembly line speed and more product through-put. A sophisticated and beneficial product structure is achieved by a method of elegant simplicity.

It will be apparent that steps requiring the turning of the overcap 28 relative to the actuator 26 may be accomplished by holding either part still and moving the other part, or by simultaneously moving both parts. Movement of the overcap 28 relative to the actuator 26 shall be understood as including all and any of those or equivalent possibilities.

Although the method of manufacturing an assembled overcap sprayer assembly of the invention may be performed in whole or in part manually, it is preferred that the steps of coaxially orienting the overcap over the actuator, thrusting the overcap and the actuator together, and turning the overcap to the closed position be accomplished by automated manipulation.

While preferred forms of the invention have been shown in the drawings and described, variations in the preferred forms will be apparent to those skilled in the art. Similarly, variations in the method of the invention will be apparent to those skilled in the art. Consequently, the invention should not be construed as limited to the specific forms and steps shown and described. Instead, the invention should be understood in terms of the following claims:

We claim:

1. An overcap sprayer assembly for use with a conventional aerosol can, the can having a valve cup with a valve cup rim and a valve having a valve stem, the overcap sprayer assembly comprising an actuator and an overcap, a. the actuator having a body and a sprayer arm, i. the body having means for attachment to the valve cup rim of the can, a skirt extending circumferentially around the perimeter of the body and extending upwardly from a lower edge to an upper edge with interiorly facing surfaces of the skirt defining an interior of the body, and an actuator access port providing access to the interior of the body; and ii. the sprayer arm having a nozzle adapted to direct spray through the actuator access port, a socket adapted to engage the valve stem, and a fluid transfer tube communicating between the nozzle and the socket; the sprayer arm being so held within the body that downward force applied to the sprayer arm moves the socket downwardly over the valve stem to activate the valve and expel contents of the can through the nozzle via the fluid transfer tube; and b. the overcap having i. means for attaching the overcap to the skirt of the actuator body in coaxially turning relation thereto, ii. an overcap dome adapted to extend over and substantially cover the actuator, iii. an overcap wall extending downwardly from the outer margins of the overcap dome, surrounding the actuator body, and iv. an overcap access port that, by turning the overcap on the actuator body, can be moved between an open position, wherein the overcap access port is aligned with the actuator access port through which the nozzle is adapted to direct spray, and a closed position, wherein the overcap wall obstructs the actuator access port;

one of the actuator body and overcap having a lock member and the other of the actuator body and overcap having a locking port opposable to and capable of receiving the lock member, the lock member having an unlocked position wherein it is not engaged in the opposed locking port and the overcap can freely turn on the actuator body, and a locked position assumed when the lock member becomes aligned with the opposed locking port, projects thereinto and engages the opposed locking port, resisting further overcap turning.

2. The overcap sprayer assembly of claim 1, wherein the means for attaching the overcap to the skirt of the actuator body includes:

a. a circumferentially extending overcap undercut projecting inwardly from the direction of the overcap wall toward the actuator skirt, and b. cooperating means formed in the actuator skirt for receiving the overcap undercut in circumferentially sliding relation.

3. The overcap sprayer assembly of claim 2, wherein the overcap access port extends inwardly for a selected distance from the outer margin of the overcap dome over each overcap undercut, to allow upwardly facing surfaces of the overcap undercuts to be formed by mold elements extending downwardly, through overcap access ports.

4. The overcap sprayer assembly of claim 2, including means for maintaining a minimum vertical separation of the overcap over the actuator, and wherein the cooperating means formed in the actuator skirt for receiving the overcap undercuts includes a skirt notch extending circumferentially in the lower edge of the actuator skirt.

5. The overcap sprayer assembly of claim 4, wherein the skirt notch has end walls, and wherein, when the overcap is turned either to its open position or its closed position, the overcap undercut stops against a skirt notch end wall, preventing further turning.

6. The overcap sprayer assembly of claim 4, wherein the skirt notch has a notch floor having detents formed thereon over which the overcap undercut must travel with resistance, the detents being so located as to partially retain the overcap in its open or closed positions.

7. The overcap sprayer assembly of claim 1, wherein the opposed locking port is the access port.

8. The overcap sprayer assembly of claim 7 wherein the lock member extends from the actuator body and is biased outwardly therefrom, and the access port is the overcap access port.

9. The overcap sprayer assembly of claim 8, wherein:

a. the body of the actuator includes an actuator dome extending inwardly from the skirt upper edge to substantially cover the skirt;

b. the overcap access port is formed at least in part in the overcap dome; and c. the lock member extends and is biased upwardly from the actuator dome, whereby the lock member, when in its locked position and engaged in the overcap access port, must be pushed downwardly to its unlocked position before the overcap can be turned toward its open position.

10. The overcap sprayer assembly of claim 8, wherein the overcap access port is formed at least in part in the overcap wall, and the lock member extends and is biased outwardly from the actuator skirt, whereby the lock member, when in its locked position and engaged in the overcap access port, must be moved to its unlocked position by being pushed radially toward the longitudinal axis of the actuator, before the overcap can be turned toward its open position.

11. The overcap sprayer assembly of claim 8, wherein the sprayer arm includes a finger button located at a position on the sprayer arm remote from the nozzle, and the actuator includes two actuator access ports so located in the body that the nozzle is directed toward a first actuator access port and the finger button is accessible through a second actuator access port remote from the first actuator access port, and including two overcap access ports so located that an overcap access port is aligned with each of the first and second actuator access ports when the overcap is in its open position.

12. The overcap sprayer assembly of claim 11 wherein the two overcap access ports are formed at least in part in the overcap wall, and two lock members adapted to engage the two overcap access ports extend and are biased outwardly from the actuator skirt, whereby the lock members, when in their locked positions and engaged in the overcap access ports, must be moved to their unlocked positions by being simultaneously pinched inwardly toward the longitudinal axis of the actuator, before the overcap can be turned toward its open position.

13. The overcap sprayer assembly of claim 7, wherein the lock member extends from the overcap and projects inwardly therefrom when the overcap is in the closed position.

14. The overcap sprayer assembly of claim 13, wherein the lock member extends from the overcap wall and projects radially and inwardly toward the actuator when the overcap is in the closed position, whereupon the lock member must be moved outwardly to move it from its locked position to its unlocked position.

15. The overcap sprayer assembly of claim 13, wherein the lock member extends from the overcap dome and projects downwardly therefrom toward the actuator when the overcap is in the closed position, whereupon the lock member must be moved upwardly to move it from its locked position to its unlocked position.

16. An overcap sprayer assembly for use with a conventional aerosol can, the can having a valve cup with a valve cup rim and a valve having a valve stem, the overcap sprayer assembly comprising an actuator and an overcap, a. the actuator having a body and a sprayer arm, i. the body having means for attachment to the can and a skirt extending circumferentially around the perimeter of the body and extending upwardly from a lower edge to an upper edge, inwardly facing surfaces of the skirt defining the interior of the body, the body having a first actuator access port providing access to the interior of the body; and ii. the sprayer arm having a nozzle adapted to direct spray through the actuator access port, a socket adapted to engage the valve stem, and a fluid transfer tube communicating between the nozzle and the socket; the sprayer arm being so held within the body that downward force applied to the sprayer arm moves the socket downwardly over the valve stem to activate the valve and expel contents of the can through the nozzle via the fluid transfer tube; and b. the overcap having i. means for attaching the overcap to the actuator body in coaxially turning relation thereto, ii. an overcap dome adapted to extend over and substantially cover the actuator, iii. an overcap wall extending downwardly from the outer margins of the overcap dome, substantially surrounding the actuator body, and iv. an overcap access port that, by turning the overcap on the actuator body, can be moved between an open position, wherein the overcap access port is aligned with the actuator access port, and a closed position, wherein the overcap wall obstructs the actuator access port;

one of the actuator body and overcap having a locking port and the other of the actuator body and overcap having a lock member having an unlocked position, wherein the overcap can freely turn on the actuator body, and a locked position, wherein, when the overcap is turned to the closed position, the lock member projects into and engages the locking port of the other of the actuator body and the overcap, the lock member in its locked position resisting further overcap turning but being manually movable to its unlocked position to allow the overcap to be turned to the open position for spraying.

17. The overcap sprayer assembly of claim 16, wherein the body includes a second actuator access port and the overcap includes a second overcap access port, and wherein the opposed locking port is one of the actuator access ports and overcap access ports.

18. The overcap sprayer assembly of claim 17, wherein the lock member extends from the actuator body and is biased outwardly therefrom, and the opposed locking port is one of the overcap access ports.

19. The overcap sprayer assembly of claim 18, wherein the opposed locking port is formed at least in part in the overcap dome, an actuator dome extends inwardly from the skirt upper edge to substantially cover the skirt, and the lock member extends and is biased upwardly from the actuator dome, whereby the lock member, when in its locked position and engaged in the opposed locking port, must be pushed downwardly to its unlocked position before the overcap can be turned toward its open position.

20. The overcap sprayer assembly of claim 18, wherein the opposed locking port is formed at least in part in the overcap wall, and the lock member extends and is biased outwardly from the actuator skirt, whereby the lock member, when in its locked position and engaged in the opposed locking port, must be moved to its unlocked position by being pushed radially toward the longitudinal axis of the actuator, before the overcap can be turned toward its open position.

21. The overcap sprayer assembly of claim 18, wherein a. the sprayer arm includes a finger button located at an end of the sprayer arm remote from the nozzle, and the two actuator access ports are so located in the body that the nozzle is directed toward the first actuator access port and the finger button is accessible through the second actuator access port remote from the first actuator access port;

b. the overcap access ports are so located that one of the overcap access ports is aligned with each of the first and second actuator access ports when the overcap is in its open position; and c. two lock members adapted to engage the two overcap access ports extend and are biased outwardly from the actuator body.

22. The overcap sprayer assembly of claim 21 wherein the two overcap access ports are formed at least in part in the overcap wall, and the two lock members adapted to engage the two overcap access ports extend and are biased outwardly from the actuator skirt, whereby the lock members, when in their locked positions and engaged in the overcap access ports, must be moved to their unlocked positions by being simultaneously pinched inwardly toward the longitudinal axis of the actuator, before the overcap can be turned toward its open position.

23. The overcap sprayer assembly of claim 16, wherein the lock member extends from the overcap and projects inwardly therefrom when the overcap is in the closed position.

24. The overcap sprayer assembly of claim 23, wherein the lock member extends from the overcap wall and extends radially and inwardly toward the actuator when the overcap is in the closed position, whereupon the lock member must be moved outwardly to move it from its locked position to its unlocked position.

25. The overcap sprayer assembly of claim 23, wherein the lock member extends from the overcap dome and projects downwardly therefrom when the overcap is in the closed position, whereupon the lock member must be moved upwardly to move it from its locked position to its unlocked position.

26. The overcap sprayer assembly of claim 16, wherein the aerosol can has a can chime and the body of the actuator includes means for attachment to the can chime.

* * * * *